US006926614B2

(12) United States Patent
Van Oirschot

(10) Patent No.: US 6,926,614 B2
(45) Date of Patent: Aug. 9, 2005

(54) PUTTING PRACTICE MEMBER

(75) Inventor: Frank Van Oirschot, Chatham (CA)

(73) Assignee: Inshes Avenue Office & Storage Limited, Chatham (CA)

( * ) Notice: Subject to any disclaimer, the term of this patent is extended or adjusted under 35 U.S.C. 154(b) by 90 days.

(21) Appl. No.: 10/387,446

(22) Filed: Mar. 14, 2003

(65) Prior Publication Data

US 2004/0180728 A1 Sep. 16, 2004

(51) Int. Cl.[7] ..... A63B 69/36
(52) U.S. Cl. ..... 473/180; 473/185; 473/162
(58) Field of Search ..... 473/157–164, 473/179–181, 185

(56) References Cited

U.S. PATENT DOCUMENTS 1,094,236 A * 4/1914 Minshall ..... 473/180
1,527,447 A * 2/1925 Smith ..... 473/185
1,693,474 A * 11/1928 Burt ..... 473/185
2,456,322 A * 12/1948 Richardson ..... 473/185
D155,370 S * 9/1949 Watkins ..... D21/790
3,424,464 A * 1/1969 Greenhouse ..... 473/180
3,659,856 A * 5/1972 Fatur ..... 473/180
4,447,059 A * 5/1984 Czajkowski ..... 473/153
4,896,886 A * 1/1990 Colley ..... 473/157
5,645,492 A * 7/1997 Anderson ..... 473/185
5,954,590 A * 9/1999 Nixey ..... 473/185
6,482,098 B1 * 11/2002 Yates ..... 473/185

* cited by examiner

*Primary Examiner*—Mark S. Graham

(57) ABSTRACT

A golf ball putting practice member has a main body portion provided with one or more golf ball receiving pockets. Each of the pockets has a pocket shape which inhibits a ball rolled into the pocket from rebounding back out of the pocket.

7 Claims, 6 Drawing Sheets

FIG. 5.
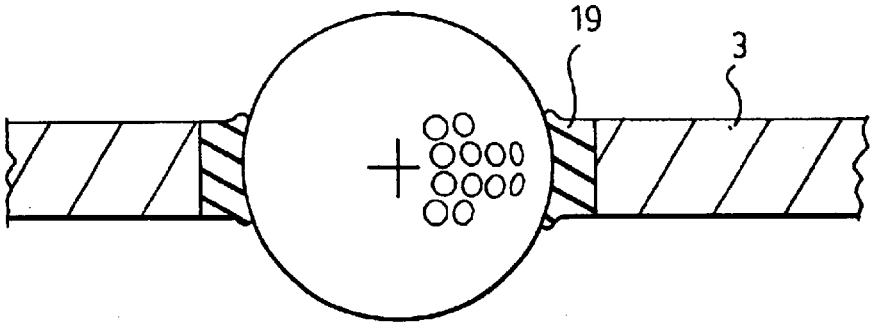
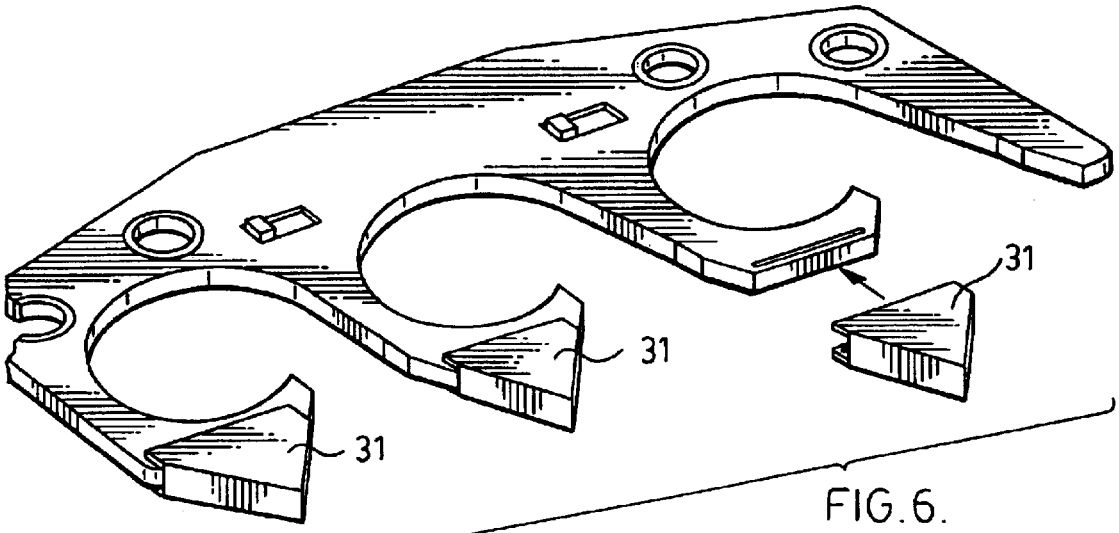
FIG. 6.
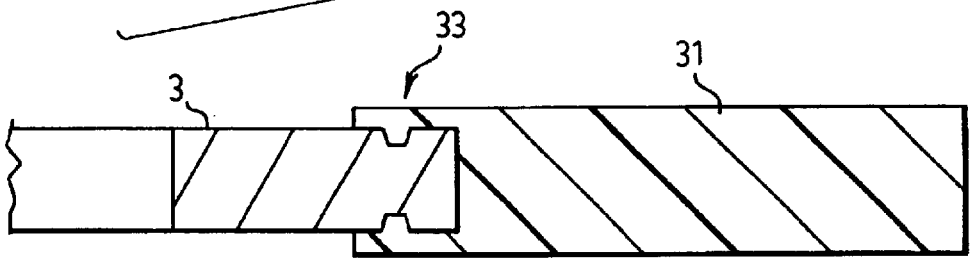
FIG. 7.

PUTTING PRACTICE MEMBER

FIELD OF THE INVENTION

The present invention relates to a golf ball putting practice member.

BACKGROUND OF THE INVENTION

Golf is becoming a game which increases in popularity on a daily basis. One part of the game which can be practiced almost anywhere is putting. Accordingly, there are many different putting practice aids presently available in the marketplace. Some of these aids are in the form of small cup like members which a person places on a carpeted surface or the like. These cup like structures are generally in the form of a center hole surrounded by a ramped wall that must be cleared to get the ball in the cup. If a ball putted at this type of aid does not clear the ramped wall into the center hole it will roll by the aid and must be retrieved by the person who is using the aid for putting practice. This is often the case because these types of aids are generally very small and hard to accurately hit with a putt. Not only can they be frustrating from this standpoint but additionally they are quite boring to use.

A more interesting type of putting aid which is also readily available in the market is one which includes an electrically operated plunger which acts as a ball return to eject a ball putted into the aid back to a person using this type of aid. However, this type of automatic ball return putting aid or practice member suffers from the drawback that it has an extremely wide or forgiving mouth opening which funnels a ball hit into the practice member to the plunger. Therefore there is very little skill level required to use this type of ball return putting aid which is in no way representative of the skill level required for real putting on a golf course green. Furthermore this type of aid is usually extremely light in weight and will bounce around with each use of the plunger on the surface where it is supported.

Another type of putting practice aid which has been more recently made available to the public is in the form of a portable simulated green having one or more regulation sized openings in the putting aid. These practice greens are made from a roll up mat of carpet material which allows their use on all different types of surfaces including non carpeted surfaces. They require much more accuracy than the electrically operated ball return aid described above because they use regulation sized putting holes but they suffer from the drawback that they distort when they are rolled up and not in use. They do not have sufficient weight to flatten the distortions when they are unrolled for further use and as such a person using them has to putt over bumps and folds in the carpet material.

There is currently nothing available in the marketplace having a solid heavy duty construction which can be used on a carpeted surface or on a non carpeted surface and having different skill level requirements for putting practice. There is further nothing currently available in the way of a putting practice aid which can be used both for putting practice and game playing purposes.

SUMMARY OF THE PRESENT INVENTION

According to one aspect of the present invention a golf ball putting practice member comprises a main body portion and a golf ball pocket in the main body portion. The golf ball pocket comprises a pocket mouth opening through one side of the main body portion and feeding to a blind ended pocket base laterally offset within the main body portion from the pocket mouth. With this setup a ball rolled through the pocket mouth is guided in a direction into the pocket base to inhibit rebounding of the ball back out through the pocket mouth. If on the other hand a ball is rolled at the practice member and misses the pocket mouth it is blocked by the main body portion from rolling past the practice member. In either case the ball is easily retrieved by a person using the practice member.

The reducing helix shape of the pocket wall at an inner side 50 of the pocket mouth 5*c* includes a discharge segment 52. The direction of a ball leaving this segment 52 is away from the pocket mouth 5*c*. This arrangement and the preferred reducing helix helps to maintain a ball in the pocket and inhibits rebounding of a ball out through the pocket mouth 5*c*. Also the angle of wall 11*c* also serves retain the ball in the pocket after leaving discharge 52. Thus a ball passing through the outer side 54 and the inner side 50 of the pocket mouth is returned in the laterally offset pocket.

According to another aspect of the invention a golf ball putting practice member includes a main body portion with a plurality of ball pockets having pocket mouths spaced from one another opening through one side of the main body portion. All of the pocket mouths have different mouth widths requiring different skill levels for putting a ball into the different ball pockets. According to this aspect of the invention the putting practice member is easily used as a putting practice game in which points are accumulated according to which particular pocket a ball is putted into by a person using the practice member. Consistent with the first aspect of the invention each pocket may be given a shape which inhibits the ball from rebounding back out of the pocket so that a person using the putting practice member as a point accumulating game will know at the end of his/her round of putted balls what the total number of points accumulated is for that particular round.

BRIEF DESCRIPTION OF THE DRAWINGS

The above as well as other advantages and features of the present invention will be described in greater detail according to the preferred embodiments of the present invention in which;

FIG. 5 is a sectional view through a ball storage region of the practice member of FIG. 1;

FIG. 6 is a perspective view of a golf ball putting practice member with changeable skill level adaptors according to further preferred embodiment of the present invention;

FIG. 7 is a sectional view through the practice member of FIG. 6 showing releasable attachment of one of the skill level adaptors to the main body portion of the practice member;

DETAILED DESCRIPTION ACCORDING TO THE PREFERRED EMBODIMENTS OF THE PRESENT INVENTION IN WHICH

Figure 1:
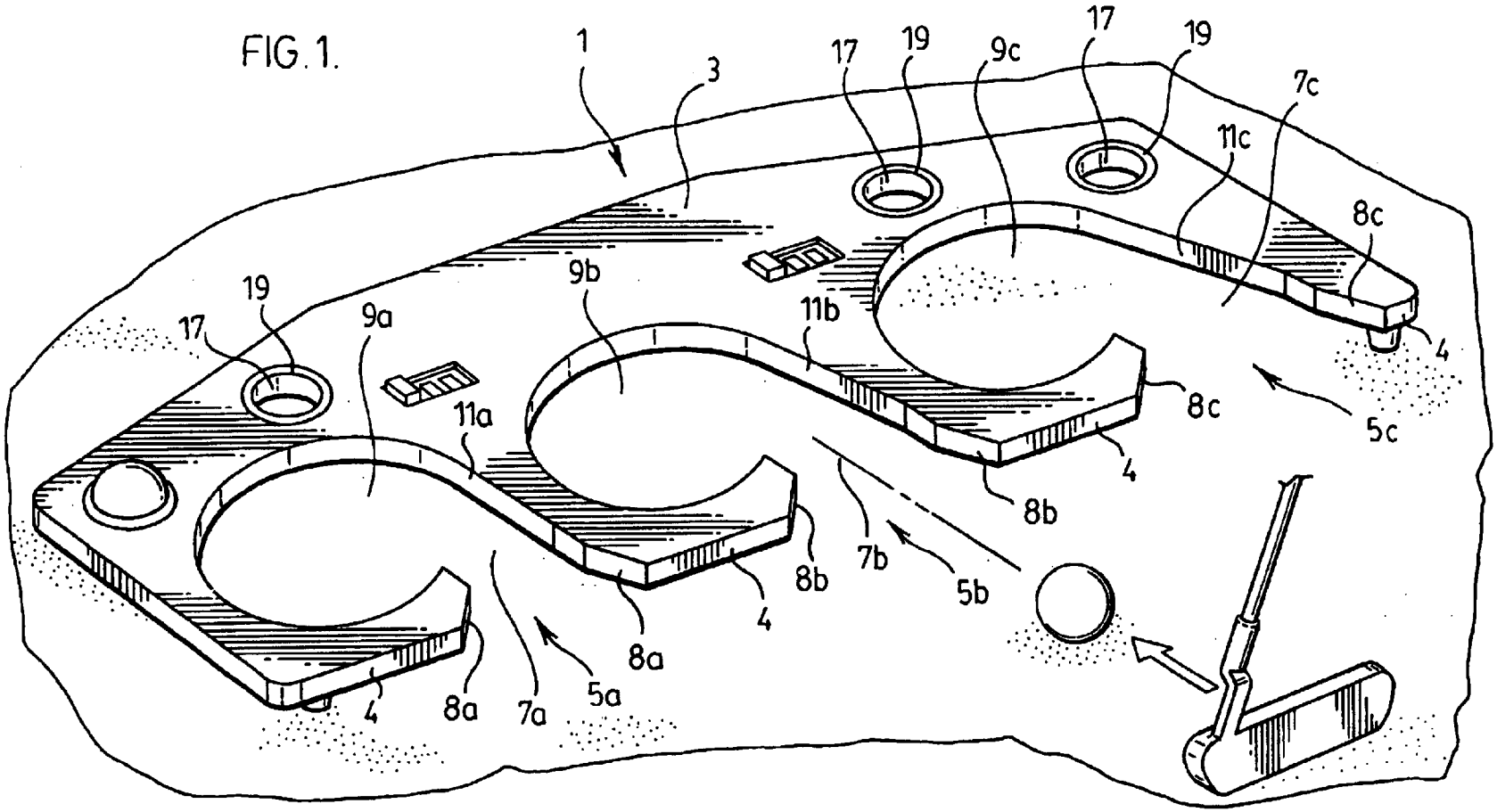
FIG. 1 is top perspective view of golf ball putting practice member according to a preferred embodiment of the present invention.

FIG. 1 shows a putting practice member generally indicated at 1. The practice member comprises a main body portion 3 having a plurality of ball receiving pockets 5*a*, 5*b* and 5*c* to the front side of the main body portion. Pocket 5*a* consists of a pocket mouth 7*a* and a blind ended pocket base 9*a*. Pocket 5*b* includes a pocket mouth 7*b* and a blind ended pocket base 9*b*. Pocket 5*c* includes a pocket mouth 7*c* and blind ended pocket base 9*c*.

All of the pocket mouths open to the same i.e., front side of the main body portion which has flat face regions 4 between and to the outer sides of the pocket mouths. Accordingly, if a ball is putted at the practice member and misses all three of the pockets it will usually be stopped by one of the face regions 4 which act as blocks to prevent the ball from rolling past the practice member. To this end it should be noted that the practice member is very substantial in width and is much wider than it is deep.

Before describing the actual pockets it should be noted that the main body portion 3 can be made from numerous different materials including metallic or aluminum materials, plastic materials, wood or wood composite materials or even stone like materials. Other than where there are apertures provided in the main body portion it has a solid construction preferably about one quarter to three quarter inches in thickness. As such, the putting practice member is substantial in weight resulting in other of benefits to be described later in detail.

Figure 2:
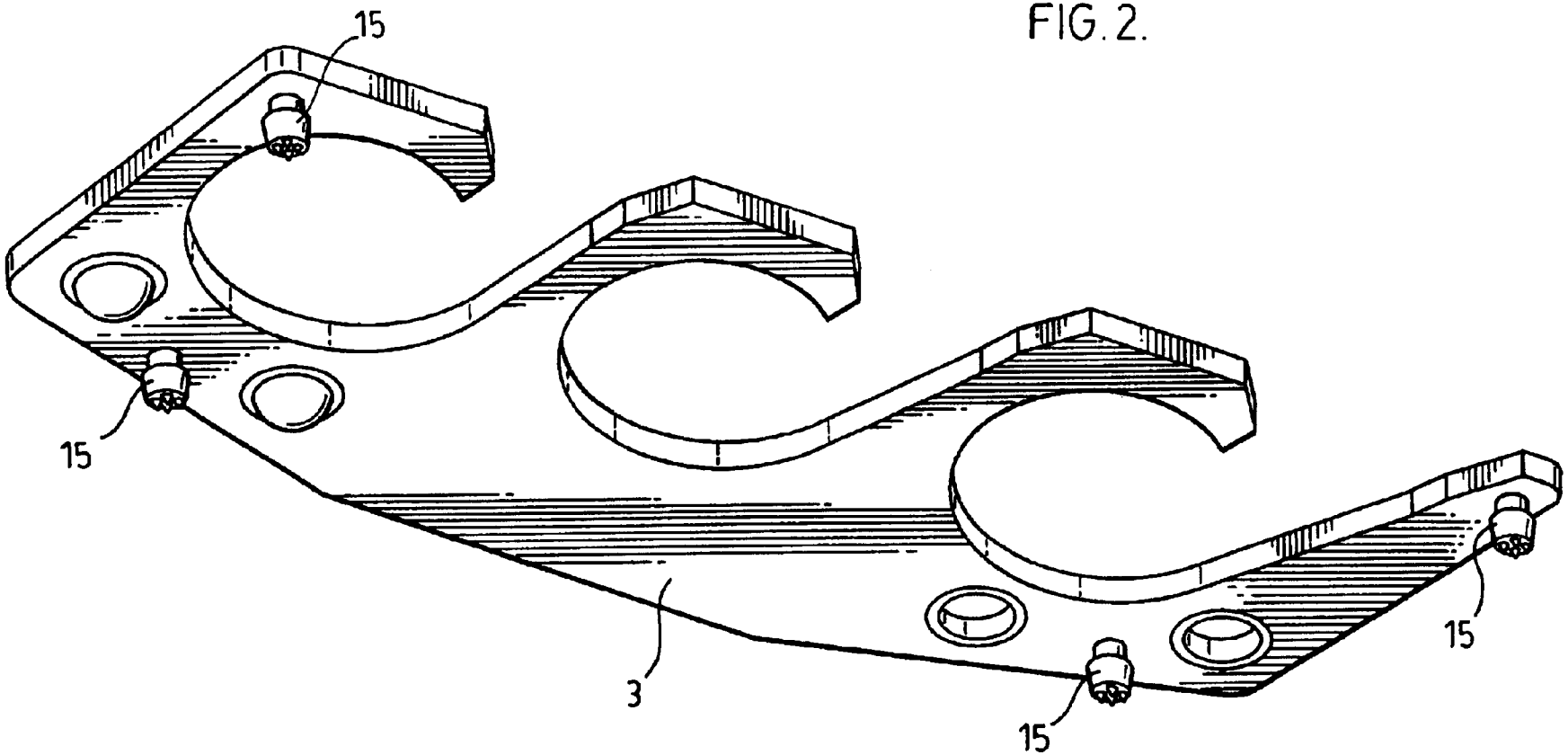
FIG. 2 is a bottom perspective view of the putting practice member of FIG. 1.

In the preferred embodiment as shown in FIG. 2 of the drawings a plurality of small legs 15 are provided on the under surface of the main body portion 3. These legs preferably have a rubber or rubber like construction and include a plurality of downwardly pointed feet on the bottom of each leg. The legs raise the main body portion to a ground elevated height. The rubber legs and in particular the pointed feet of the rubber legs enhance grip of the practice member on any type of surface on which the practice member is used. Among other benefits this greatly enhances stability of the practice member which, because of its substantial weight, presses down on the legs so that the practice member is essentially immoveable when impacted by a golf ball.

The main body portion 3 of practice member 1 in the preferred embodiment as shown is additionally provided with a plurality of ball storage openings 17. Each of these openings is surrounded by a friction insert 19 which may for example have a soft rubber construction. Openings 17 within the inserts 19 are sized such that a golf ball can be pressed into each opening and held in position by the rubber insert as indicated to the extreme left side of FIG. 1. This allows the practice member to be carried along with the practice golf balls which are stored directly with the practice member to any desired location.

One of the keys to the present invention lies in the shaping of each of the ball receiving pockets. More particularly, the blind ended pocket base of each pocket is offset laterally within the main body portion of the practice member relative to the mouth of each pocket. In the preferred embodiment as shown, each pocket has a bordering wall with a reducing helix configuration leading from the pocket mouth completely around the base of the pocket.

Figure 3:
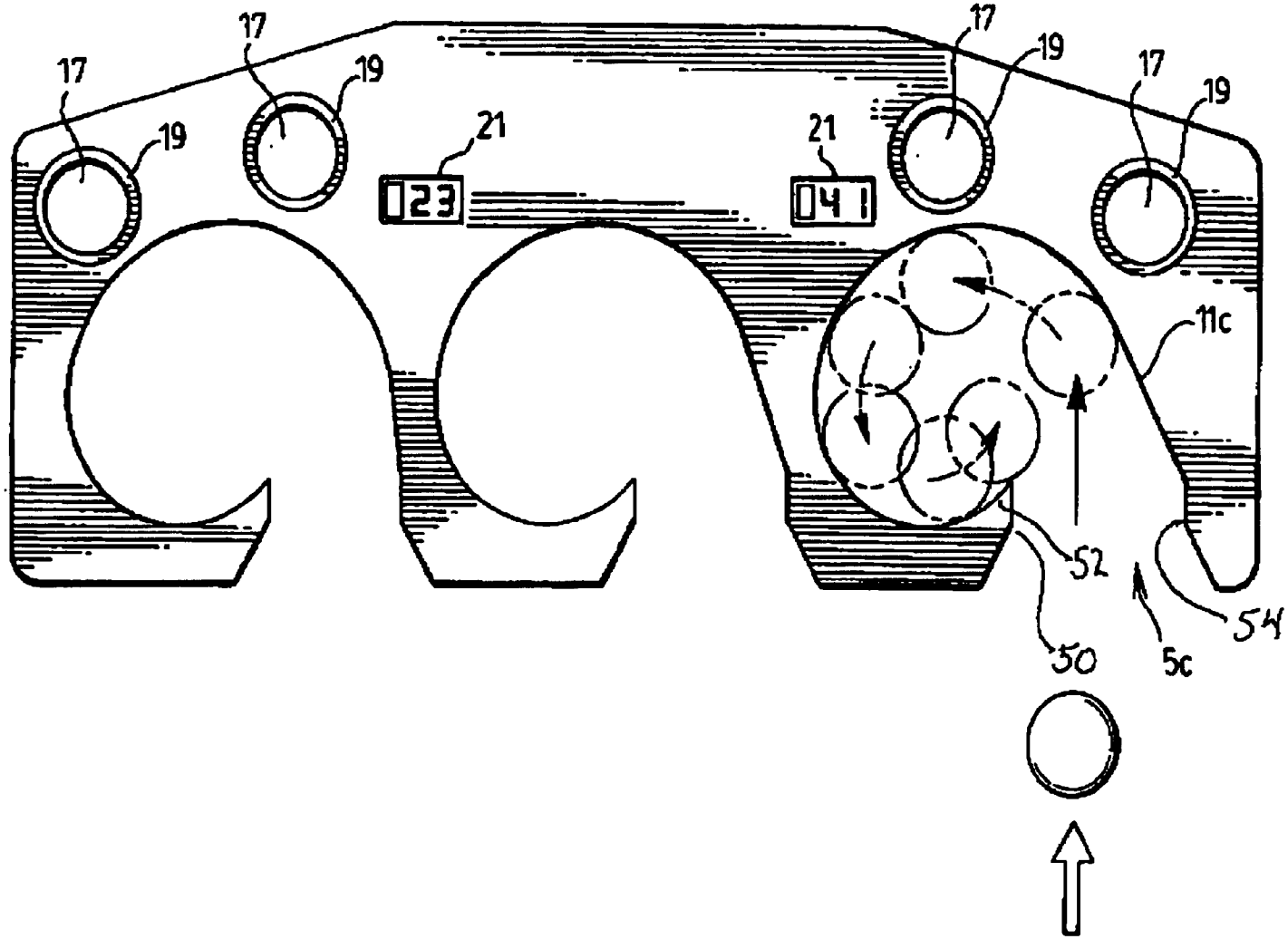
FIG. 3 is a top view of the putting practice member of FIG. 1 showing direction of ball travel of a golf ball putted into one of the pockets of the practice member.

As a result of the lateral offsetting of the pocket base relative to the pocket mouth and in particular the reducing helix configuration of the wall defining each pocket, a ball when rolled into the pocket will be inhibited from rebounding back out of the pocket mouth. This is well shown for example in FIG. 3 of the drawings which shows direction of ball travel after it has been rolled into pocket 5*c*. The reducing helix shape of the pocket wall continuing from the pocket mouth completely around the pocket base causes an inward spiraling of the ball essentially trapping it within the pocket base after it has cleared past the pocket mouth.

Figure 4:
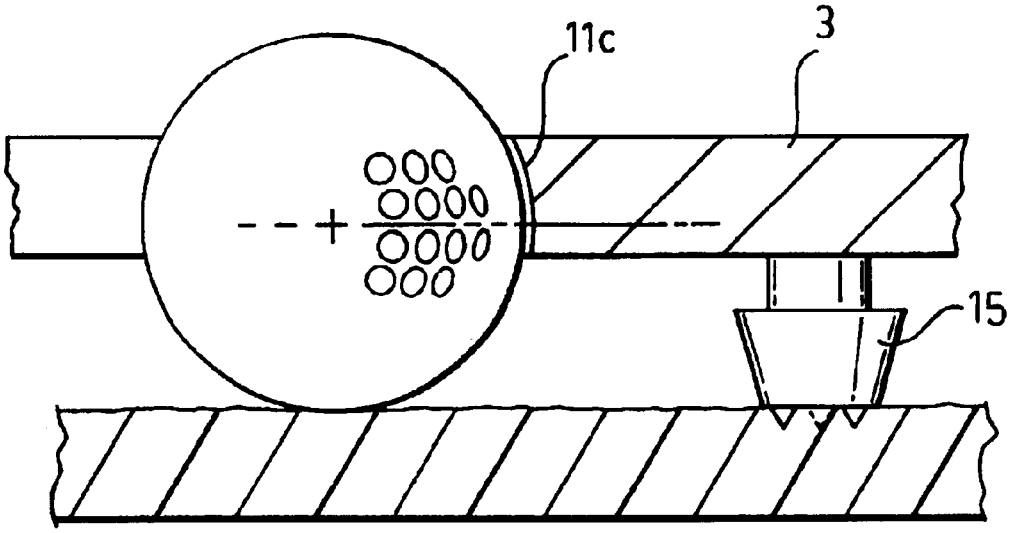
FIG. 4 is a sectional view through a pocket region of the main body portion of the practice member of FIG. 1.

Another feature of the present invention which is provided to reduce the likelihood of a ball rebounding out of any one of the pockets in that each pocket is provided with a ball speed reducing wall surface region 11*a* for pocket 5*a*, 11*b* for pocket 5*b* and 11*c* for pocket 5*c*. FIG. 4 shows wall surface region 11*c* of pocket 5*c* which has a curved undercut configuration matching the exterior curvature of a golf ball rolled onto wall surface 11*c*. Note that legs 15 elevate the main body portion 3 to a position such that the surface of wall region 11*c* is above the centerline of the golf ball and therefore forces the ball downwardly onto the ball rolling surface beneath the main body portion. This downward pushing on the ball as well as the cyclonic motion of the ball created by the reducing helix shape of the wall along its length dissipates the energy of the ball i.e., has a braking effect on the ball further enhancing the chances that the ball will remain within the pocket.

Note that the mouth 7*c* of pocket 5*c* includes angled or tapered mouth walls 8*c* which guide the ball onto the wall surface region 11*c* to ensure the contact of the wall with the wall surface. Similar angled mouth walls 8*a* and 8*b* are provided at pockets 5*a* and 5*b*.

FIGS. 6 and 7 of the drawings show another preferred feature of the present invention in which adaptors 31 can be releaseably secured to the front side of the main body portion of the putting practice member. These adaptors spread the width of the mouths of the pockets to increase the mouth opening of each of the ball receiving pockets. As such, the adaptors make it much easier for a person such as a golfing novice or a young child to play with the putting practice member and still have some satisfaction by getting the balls to roll into the different pockets.

The putting practice member with the adaptors may however be too easy to use for a more accomplished golfer who is then able to remove the adaptors. This returns the putting practice member to its higher skill level requiring state.

FIG. 7 shows a male to female interlock 33 which can be used to secure the adaptors to the main body portion of the putting practice member. Obviously, other types of connection methods could also be used.

In a further embodiment of the invention not shown in the drawings the putting practice member can be built with a configuration similar to what is shown in FIG. 6 of the drawings but not including detachable adaptors. In this configuration, the adaptors would be part of the construction designed principally for less skilled players or players just taking up practice putting.

When the practice member is set at a high skill lever state pocket 5*a* for example, may have a mouth opening 7*a* which is smaller in width than the width of a standard cup or hole in a regulation golf course green. This undersized width of pocket mouth 5*a* makes it extremely difficult to putt through at almost any distance and in particular at a distance of several yards or more away from the putting practice member.

In comparison to the undersized width of mouth 7*a* of pocket 5*a* the mouth 7*b* of pocket 5*b* may be consistent in width with a regulation green cup size and the mouth 7*c* of pocket 5*c* may be greater than a regulation cup size.

The above variances in the mouth sizes of the different pockets not only provides different skill levels for putting into the different pockets but additionally makes the putting practice member extremely versatile for use as a putting game. When used as a game each of the pockets is attributed a certain point value with the smaller mouth pocket 5*a* having a higher point value than pocket 5*b* which in turn has a higher point value than pocket 5*c*. When a number of people play at one time they will accumulate their points over a number of different putting rounds. The person with the highest point value will win the game. To this end the practice member is preferably provided with small counters 21 which show the number of points accumulated by the players throughout the game.

One of the primary benefits provided by the shaping of each pocket to prevent ball rebound out of the pocket is that when the putting practice member is used in a game manner, as described immediately above, each person will know at the end of an individual round the number of points he or she has accumulated. This is because the balls remain in the pocket even if each pocket receives more than one ball at a time.

In addition to the functional advantage of trapping the ball within a pocket for scorekeeping purposes the cyclonic or spiraling action of the ball in the pocket further has an eye-catching feature as the balls swirl within the pockets.

Figure 8:
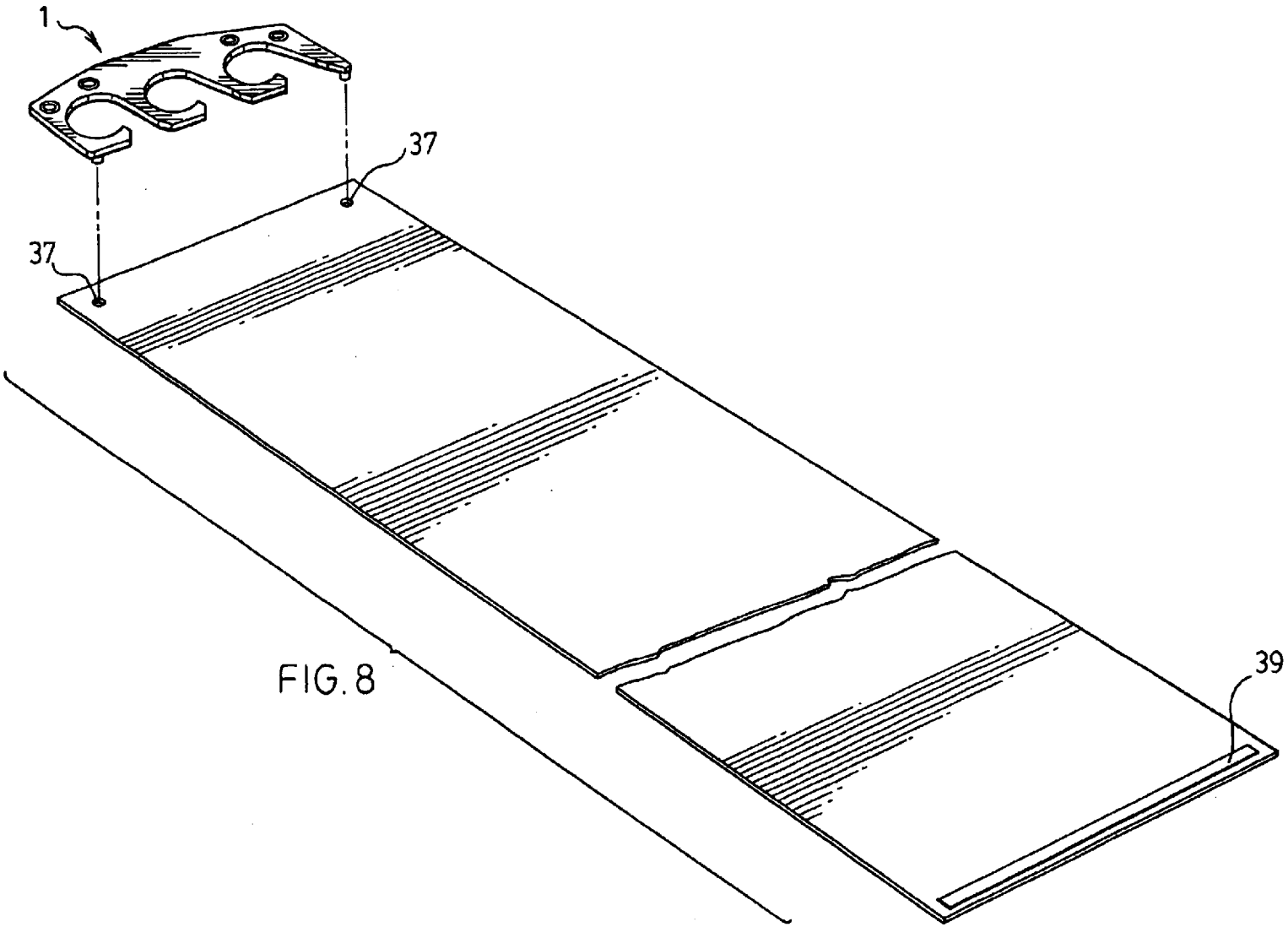
FIG. 8 is a perspective view of a golf ball putting practice member and attachable practice mat according to a further preferred embodiment of the present invention.

FIG. 8 of the drawings shows a further embodiment of the invention which enables practice member 1 to be used equally as well on a non carpeted surface. According to this embodiment a separate putting mat 35 is useable with practice member 1. This putting mat includes openings 37 which fit over the legs 15 of practice member 1. A separate weight 39 is provided at the end of mat 35 away from the practice member.

Mat 35 which preferably has an indoor/outdoor carpet construction is a roll-up mat may which can be easily stored when not in use. It can then be unrolled to the use position as shown in FIG. 8 of the drawings.

Unlike prior art roll-up mats, mat 35 does not suffer from the fact that it sustains folds or pinches that cannot be pulled out of the mat when it is unrolled. This is because the mat uses the weight of the practice member 1 which will weigh several pounds or more, depending upon the material from which it is made, to help pull the mat in combination with weight 39 to a taut position in which any folds or pinches are pulled out of the mat.

According to another aspect of the invention weight 39 is replaced by a second putting practice member facing the first putting member. The two practice members hold the mat taut and allow two people to practice one from each end of the mat. No ball retrieval is required in this set up because the balls are putted back and forth between the two people.

Although various preferred embodiments of the present invention have been described in detail, it will be appreciated by those skilled in the art that variations may be made without departing from the spirit of the invention or the scope of the appended claims.

The embodiments of the invention in which an exclusive property or privilege is claimed are defined as follows:

1. A golf ball putting practice member comprising a main body portion and a golf ball pocket in said main body portion, said golf ball pocket comprising a pocket mouth opening through one side of said main body portion and feeding to a blind ended pocket base laterally offset within said main body portion from said pocket mouth such that a ball rolled through said pocket mouth is guided in a direction into said pocket base to inhibit rebounding of the ball back out through the pocket mouth;

said golf ball pocket including a bordering wall with a reducing helix configuration from said pocket mouth to said pocket base;

said pocket mouth being defined by inwardly tapering mouth walls to opposite sides thereof at said one side of said main body portion; and wherein said inwardly tapering mouth walls are directed at a ball speed reducing undercut wall surface region in said pocket.

2. A golf ball putting practice member as claimed in claim 1 wherein said undercut wall surface region is curved to a golf ball surface contour.

3. A golf ball putting practice member as claimed in claim 1 wherein said main body portion includes base legs which hold said main body portion in a ground elevated position.

4. A golf ball putting practice member as claimed in claim 1 including base legs which hold said main body portion in a ground elevated position placing said ball speed reducing wall surface region of said pocket at a height to push downwardly on a golf ball rolled into said golf ball pocket.

5. A golf ball putting practice member including a main body portion having a plurality of different ballpockets therein, said ball pockets having pocket mouths spaced from one another opening through one side of said main body portion, all of said pocket mouths having different mouth widths requiring different skill levels for putting a golf ball into said different ball pockets and wherein at least one of said ball pockets is a blind ended pocket laterally offset relative to the pocket mouth thereof, said blind ended pocket and said pocket mouth cooperating to consistently guide a ball rolled through said pocket mouth into said laterally offset blind ended pocket and to inhibit rebounding of the ball back out through the pocket mouth and wherein each pocket includes a pocket base laterally offset from the pocket mouth thereof, each pocket having a bordering wall with a reducing helix configuration shaped to inhibit a ball which is rolled therein from rebounding back out of the pocket.

6. A golf ball putting practice member as claimed in claim 5 wherein said pocket mouth has an outer side and an inner side with said inner side being adjacent the lateral offset of said blind ended pocket base said blind ended pocket base adjacent said inner side of said pocket mouth including a discharge segment directing a ball leaving therefrom in a direction away from said pocket mouth.

7. A golf ball putting practice member as claimed in claim 6 wherein said discharge segment is part of a reducing spiral of said blind ended pocket base.

* * * * *